US009972941B2

(12) United States Patent
Benedict et al.

(10) Patent No.: US 9,972,941 B2
(45) Date of Patent: May 15, 2018

(54) MEMORY MODULE CONNECTOR

(71) Applicant: HEWLETT PACKARD ENTERPRISE DEVELOPMENT LP, Houston, TX (US)

(72) Inventors: Melvin K Benedict, Magnolia, TX (US); Stephen F Contreras, Spring, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 17 days.

(21) Appl. No.: 15/106,655

(22) PCT Filed: Jan. 29, 2014

(86) PCT No.: PCT/US2014/013491
§ 371 (c)(1),
(2) Date: Jun. 20, 2016

(87) PCT Pub. No.: WO2015/116043
PCT Pub. Date: Aug. 6, 2015

(65) Prior Publication Data

US 2017/0005438 A1 Jan. 5, 2017

(51) Int. Cl.

| | |
|---|---|
| ***H01R 12/00*** | (2006.01) |
| ***H01R 13/6471*** | (2011.01) |
| ***H01R 12/52*** | (2011.01) |
| ***H01R 12/72*** | (2011.01) |
| ***H01R 12/73*** | (2011.01) |

(52) U.S. Cl.
CPC ..... *H01R 13/6471* (2013.01); *H01R 12/52* (2013.01); *H01R 12/721* (2013.01); *H01R 12/737* (2013.01)

(58) Field of Classification Search
CPC . H01R 23/7068; H01R 23/725; H01R 9/0735
USPC ..... 439/61, 631, 67
See application file for complete search history.

(56) References Cited

U.S. PATENT DOCUMENTS

| | | | |
|---|---|---|---|
| 5,272,664 | A | 12/1993 | Alexander et al. |
| 5,496,180 | A | 3/1996 | Fabian et al. |
| 6,287,132 | B1 | 9/2001 | Perino et al. |
| 6,658,530 | B1 | 12/2003 | Robertson et al. |

(Continued)

FOREIGN PATENT DOCUMENTS

WO WO-2013100929 A1 7/2013

OTHER PUBLICATIONS

International Searching Authority, The International Search Report and the Written Opinion, dated Oct. 24, 2014, 10 Pages.

(Continued)

*Primary Examiner* — Phuong Chi T Nguyen
(74) *Attorney, Agent, or Firm* — Lakshmikumaran and Sridharan

(57) ABSTRACT

A memory module connector (100) is described herein. The memory module connector (100) comprises a plurality of connector pins (102) distributed into a plurality of columns (104). The plurality of connector pins (102) further comprises a plurality of ground pins (106) for providing electrical ground to the memory module connector (100) and a plurality of signal pins (108) for carrying data signals across the memory module connector (100). Further, for each signal pin (108) provided in a column (104), each connector pin (102) adjacent to the signal pin (108) in an adjacent column (104) is a ground pin (106).

20 Claims, 4 Drawing Sheets

(56) References Cited

U.S. PATENT DOCUMENTS

| | | | |
|---|---|---|---|
| 7,407,415 | B2 | 8/2008 | Shan et al. |
| 8,465,327 | B2 | 6/2013 | Springer et al. |
| 2004/0203269 | A1 | 10/2004 | Kameyama et al. |
| 2011/0250768 | A1 | 10/2011 | Springer et al. |
| 2012/0077357 | A1 | 3/2012 | Zou et al. |
| 2013/0051491 | A1 | 2/2013 | Kim et al. |

OTHER PUBLICATIONS

Nieh. C; "Far-end Crosstalk Cancellation Using via Stub for Ddr4 Memory Channel"; May 28-31, 2013; 2 pages.

MEMORY MODULE CONNECTOR

BACKGROUND

Computing systems typically include numerous types of memory modules, such as dynamic random access memory (DRAM), synchronous dynamic random access memory (SDRAM), and extended data out random access memory (EDO RAM) for storing data generated or imported in the computing system. The memory modules are typically coupled to a motherboard of the computing system using a memory module connector corresponding to a format of the memory module. For instance, a dual in-line memory module (DIMM) may be coupled to the motherboard using a DIMM connector, while a single in-line memory module (SIMM) may be coupled using a SIMM connector. The memory modules are typically mounted onto the connector by plugging the memory module into the memory module connector for being coupled to the motherboard.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the figures to reference like features and components.

DETAILED DESCRIPTION

Figure 1:
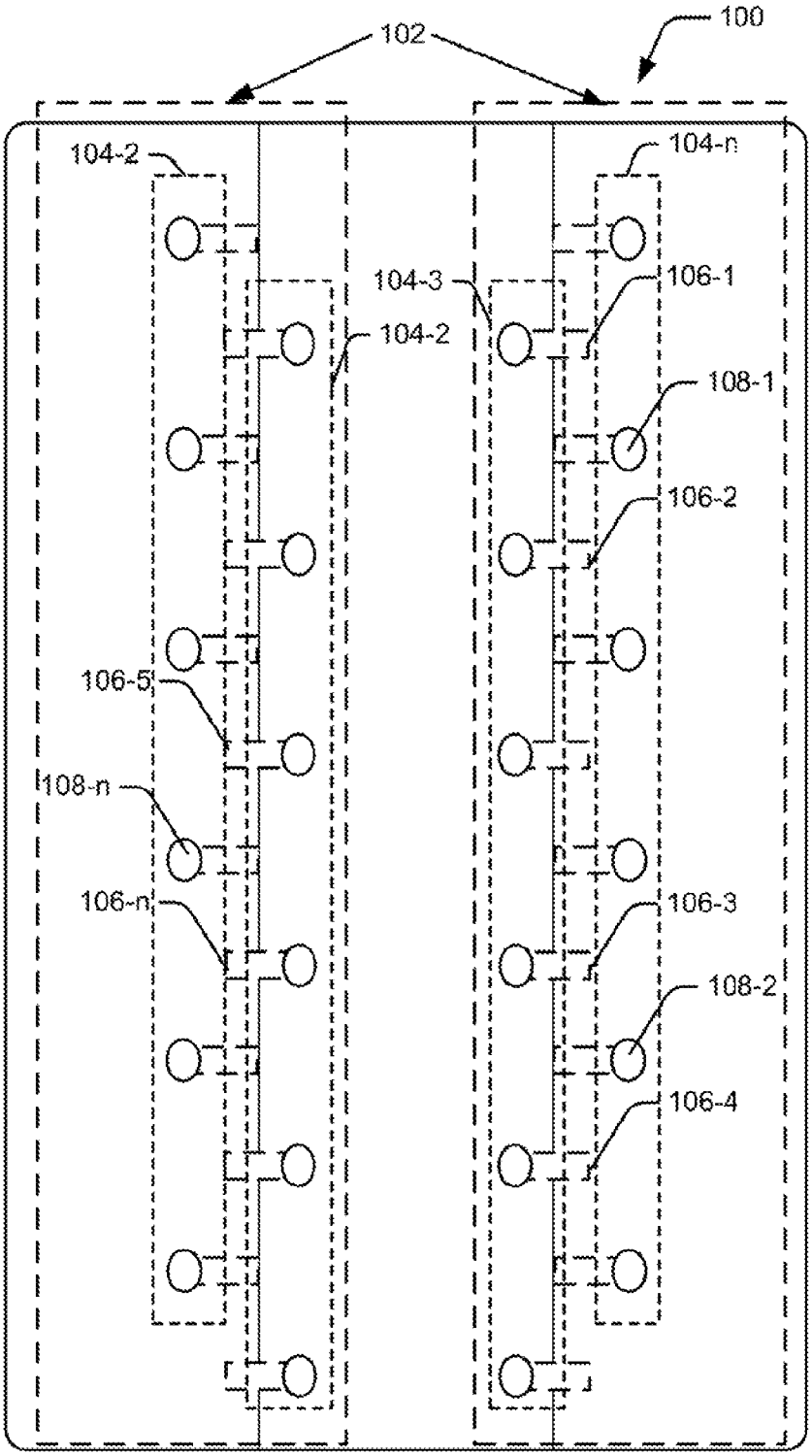
FIG. 1 illustrates a memory module connector, according to an example of the present subject matter.

The present subject matter relates to memory module connectors for computing systems. The computing systems, such as desktop computers, hand-held devices, mainframe computers, workstations, multiprocessor systems, laptop computers, network computers, minicomputers, and servers, include numerous types of electronic modules. For example, the computing systems include processors for processing data, and memory modules for storing data. The memory modules typically include a series of modules, i.e., integrated circuits of memories, such as dynamic random access memory (DRAM) and synchronous dynamic random access memory (SDRAM). The modules are generally mounted on a printed circuit board (PCB).

Memory modules are typically coupled to a motherboard of the computing system using a memory module connector. The memory module connector further may include a plurality of connector pins. The connector pins may be further connected to the motherboard to provide a communication path between the memory module connector and the motherboard. A memory module, for use, is mounted by plugging the memory module into the connector. As the memory module is plugged in, it comes in contact with the connector pins, which in turn couple the memory module with the motherboard.

The memory modules are produced in a number of formats, such as single in-line memory modules (SIMMs), dual in-line memory modules (DIMMs), and fully buffered DIMM's. The SIMM memory modules include redundant or same contact pins, for creating electrical contacts with the connector pins, on both, front and back, sides of the memory module. The DIMM, which are more recent versions of memory modules, includes separate contact pins on back and front sides, thereby providing almost double data paths as compared to the SIMM.

Further, with development of the DRAMs and SDRAMs, the DIMM has also evolved over the time. For instance, the DRAMs or SDRAMs used in the DIMM have evolved from basic Double Data Rate (DDR) DRAMs or DDR SDRAMs to DDR2, DDR3, and recently developed DDR4 memories. Evolution of the DRAMs has facilitated an increase in data storage and transfer rate or speed of the DIMM memory module. Further, in order to facilitate the high data transfer rates, the memory module interface of the DIMM and the memory module connectors corresponding to the DIMM too have been modified to incorporate more number of contact pins and connector pins, respectively. For instance, the memory module connectors and the memory module interface of the DDR2 DIMMs and the DDR3 DIMMs typically have 240 connector pins and contact pins instead of the 184 pin structure used in the DDR DIMM. DDR4 DIMMs, being the advanced versions of DDR3 DIMMs typically have 288 contact pins.

Generally, the DDR4 DIMMs are high performance memory modules defined to support high data transfer rates of about 3200-4266 megatransfers per second (MT/s). However, owing to various factors, the DDR4 DIMMs currently developed have been able to achieve lesser data transfer rates as compared to the optimal data transfer rates of 3200 MT/s. One of such factors that may affect the data transfer rates across the DDR4 DIMMs is signal-to-signal crosstalk which may occur within the memory module connector. The crosstalk is typically induced due to interference between signals mapped to closely placed connector pins on the memory module connector. For instance, in the current pin layout of the memory module connectors, many signal carrying connector pins are placed close to each other. The pin layout being such that at places even up to four signal carrying connector pins are placed adjacent to each other, thus increasing likelihood of the crosstalk between the signals. Such crosstalk may induce errors into signal lines on the DIMMs. As a result, the crosstalk may limit the data transfer rates across the DIMMs. Further, with increase in speed of operations by the DIMM, the chances of interference, and hence crosstalk, between the signals too may increase. For instance, owing to signal-to-signal crosstalk in the current DDR4 DIMM designs, transfer rates of the DDR4 DIMMs may be low. In one example, the data transfer rates may reduce by around 50%-60% of optimal data transfer rates in three DIMMs per channel (DPC) conditions.

Presently, providing additional ground ($V_{ss}$) pins in the memory module connectors may be used for reducing crosstalk. Providing additional ground pins may reduce the crosstalk, but it may lead to increase in cost and package size of the memory module connectors. In another example, connector pins may have a dielectric material embedded within the connector pin. The dielectric material facilitates a decrease in the crosstalk between the signals mapped to the adjacent connector pins and thus facilitates in avoiding additional ground pins in the DIMM connector. However, such a design of the connector pins embedding the dielectric material may increase cost and complexity of manufacturing the connector pins and in turn the memory module connectors.

A memory module connector for a memory module, in accordance with an example of the present subject matter, is described. The memory module connector as described herein includes a plurality of ground pins and a plurality of signal pins arranged into a plurality of columns such that no two signal pins provided in two different columns are adjacent to each other. The signal pin may be considered, as per one example, as a connector pin carrying data signals. The ground pin may be considered, as per one example, as a connector pin providing electrical ground to the memory module connector. The resulting memory module connector achieves reduced or negligible crosstalk as compared to the current memory module connectors.

The memory module connector as described includes a plurality of connector pins distributed into the plurality of columns such that each column includes a predetermined number of connector pins. Examples of the connector pins include, but are not limited to, signal pins, ground pins, data strobe pins, supply pins, clock pins, and reference pins. In one example, the number of connector pins may be determined based on the type of the memory module that will be mounted in the memory module connector. For instance, the memory module connector may include 288 pins for a DDR4 DIMM. The 288 pins in the memory module connector of the DDR4 DIMM may be distributed into four columns such that each column includes 72 connector pins. Further, the connector pins are arranged in the columns such that for each signal pin provided in a column, each connector pin adjacent to the signal pin in an adjacent column is a ground pin.

In an example, the connector pins may be distributed in the columns such that two signal pins provided in alternate columns are separated by a ground pin provided in a column separating the alternate columns. For instance, the connector pins may be distributed into four columns—a first column, a second column, a third column, and a fourth column. The connector pins may be distributed into the four columns such that odd numbered connector pins are arranged into the first column and the fourth column, while even numbered connector pins are arranged into the second column and the third column. The odd numbered connector pins may be the connector pins corresponding to odd numbered contact pins of the memory module. The even numbered connector pins may be the connector pins corresponding to even numbered contact pins of the memory module.

In another example, the connector pins may be distributed into the four columns such that odd numbered connector pins are arranged into the second column and the third column, while even numbered connector pins are arranged into the first column and the fourth column. In an example, the memory module connector is provided in a computing system for coupling a memory module to a platform printed circuit board (PCB) of the computing system. For instance, the memory module connector may be used to connect the memory module, such as a dual in-line memory module (DIMM) to the platform PCB, such as a motherboard of the computing system. Further, the memory module may be a high speed and a high performance DIMM, such as a DDR3, DDR4, or DDR5 DIMM.

Providing the columns having the even numbered connector pins in between the columns having the odd numbered connector pins or having the odd numbered connector pins in between the columns having the even numbered connector pins positions the connector pins such that each signal pin has a ground pin as its adjacent pin in an adjacent column. Such a positioning thus facilitates in ensuring that no two signal pins provided in two different columns are adjacent to each other.

In another example, the connector pins may be distributed in the columns such that the ground pins and the signal pins are provided in different columns. The ground pins are distributed into two columns while the signal pins are distributed into two other columns different from the columns having the ground pins. Further, the columns may be arranged such that the columns comprising the signal pins are separated by the two columns comprising the ground pins. For instance, the connector pins may be distributed into four columns such that the signal pins are arranged into the first column and the fourth column, while the ground pins are arranged into the second column and the third column. Such a positioning thus facilitates in ensuring that signal pins provided in two different columns are separated by two ground pins and are thus not adjacent to each other. Further, in said example the data strobe pins are positioned such that two adjacent data strobe pins arranged in a same column of connector pins are separated by a coupling distance. The coupling distance is a distance less than a distance by which other connector pins provided in the same column are separated.

The present subject matter thus facilitates in shielding the ground pins from each other. Shielding the ground pins helps in reducing the crosstalk between the signal pins, thus reducing errors in signal transfer across the memory modules. For instance, separating the signal pins in two different columns by providing at least one column having a ground pin helps in achieving shielding of signals carried by the signal pins, thus reducing the crosstalk between the signals. Reducing the crosstalk further facilitates in achieving high data transfer rates in high speed memory modules, such as the DDR4 DIMM. Further, reducing the distance between the data strobe pins to a distance equal to the coupling distance helps in reducing a coupling disturbance when data signal are transmitted from the memory module to the platform PCB. This further improves an operating margin of the signals. Further, positioning of the connector pins as described herein facilitates in achieving the shielding of the signal pins without requiring any change in the pin layout of the memory module.

The manner in which the present subject matter is implemented is explained in details with respect to FIGS. 1 to 4. While aspects of the present subject matter can be implemented in any number of different systems, environments, and/or configurations, the examples are described in the context of the following system(s).

FIG. 1 illustrates a memory module connector 100, according to an example of the present subject matter. The memory module connector 100 may be used in a computing device (not shown in the figure) to receive a memory module (not shown in the figure), such as a dual in-line memory module (DIMM). The memory module connector 100 may be connected to a platform printed circuit board (PCB) (not shown in the figure) of the computing device for coupling the memory module to the platform PCB, such as a motherboard.

The memory module connector 100 includes a plurality of connector pins 102. The connector pins 102 are electrically connected to the platform PCB to provide a communication path between the memory module connector 100 and the motherboard. In one example, the number of connector pins 102 may be determined based on the type of the memory module that will be mounted in the memory module connector 100. The connector pins 102 are distributed into a plurality of columns 104-1, 104-2, 104-3, . . . , 104-n. The connector pins 102 include, amongst other pins, a plurality of ground pins 106-1, 106-2, 106-3, 106-4, 106-5, . . . , 106-n and a plurality of signal pins 108-1, 108-2, . . . , 108-n. The ground pins 106-1, 106-2, 106-3, 106-4, 106-5, . . . , 106-n are hereinafter collectively referred to as ground pins 106 and individually referred to as ground pin 106. The signal pins 108-1, 108-2, . . . , 108-n are hereinafter collectively referred to as signal pins 108 and individually referred to as signal pin 108. The ground pin 106 is a connector pin 102 providing electrical ground to the memory module connector 100. The signal pin 108 is a connector pin 102 carrying data signals from the memory module to the platform PCB.

As mentioned previously, the connector pins 102 are distributed into a plurality of columns 104-1, 104-2, 104-3, . . . , 104-n (hereinafter collectively referred to as columns 104 and individually referred to as column 104). The connector pins 102 are distributed into the columns 104 such that each column 104 includes $1/n^{th}$ number of connector pins 102 present in the memory module connector 100. Thus, if the memory module connector 100 includes 'm' number of connector pins 102, then each column 104 may include m/n number of connector pins 102. For example, if the memory module connector 100 includes 'm' number of connector pins 102, and these connector pins 102 are distributed into four columns 104, then each column 104 may include m/4 number of connector pins 102.

The connector pins 102 are further positioned in the columns 104 such that two signal pins 108, provided in two different columns 104 are not adjacent to each other. In one example, the signal pins 108 are positioned such that the connector pins 102 that are adjacent to the signal pins 108 in the column 104 adjacent to the column 104 in which the connector pins 102 are positioned is the ground pin 106.

In one example, the signal pins 108 and the ground pins 106 are positioned such that the signal pin 108 always has the ground pin 106 as its adjacent connector pin 102 in an adjacent column 104, i.e., in the column 104 adjacent to the column 104 in which the signal pin 108 is positioned. Providing the ground pins 106 adjacent to the signal pins 108 facilitates in shielding the signal pins 108 from each other. Such a shielding of the signal pins 108 reduces crosstalk between the signal pins 108. For instance, as illustrated in the FIG. 1, the signal pin 108, say, the signal pin 108-1 positioned in the column 104-n is surrounded by the ground pins 106, say, the ground pins 106-1 and 106-2 in the adjacent column 104-3. Similarly, the signal pin 108-2 positioned in the column 104-n is surrounded by the ground pins 106-3 and 106-4 in the adjacent column 104-3. Thus, as illustrated the signal pins 108 positioned in a column 104 are surrounded by ground pins 106 in the adjacent column 104.

Figure 2:
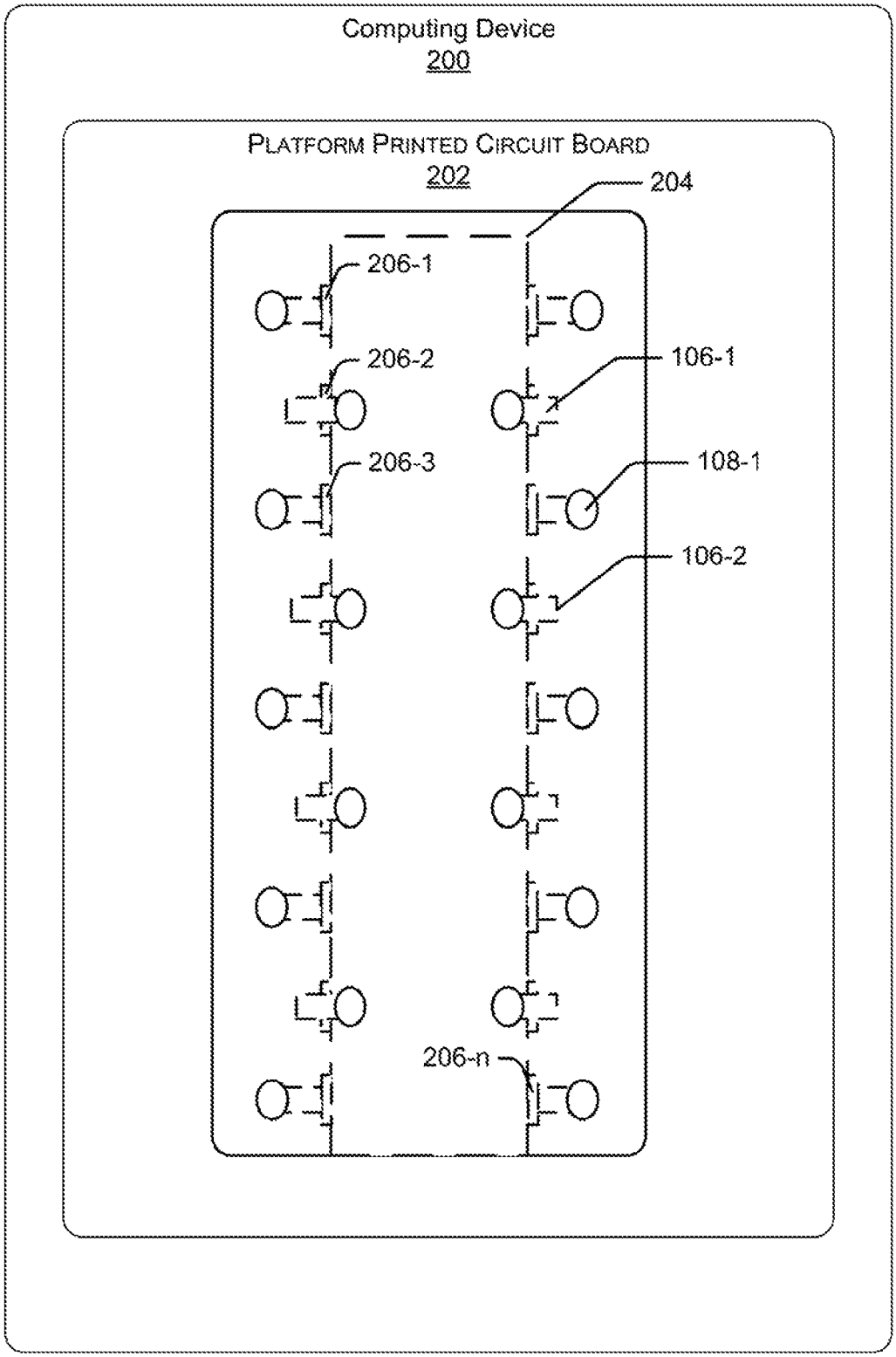
FIG. 2 illustrates a block diagram of a computing device comprising the memory module connector, according to an example of the present subject matter.

FIG. 2 illustrates a block diagram of a computing device 200 comprising the memory module connector 102, according to an example of the present subject matter. Examples of the computing device 200 include, but are not limited to, desktop computers, hand-held devices, mainframe computers, workstations, multiprocessor systems, laptop computers, network computers, minicomputers, and servers. The computing device 200 further includes a platform PCB 202, such as a motherboard on which the memory module connector 102 may be connected. The memory module connector 102 may be electrically connected to the platform PCB 202 via the connector pins 102. Examples of the connector pins 102 include, but are not limited to, the signal pins 108, the ground pins 106, data strobe pins, supply pins, clock pins, address pins, bank address pins, chip select pins, clock enable pins, and reference pins.

The connector pins 102 may include a first end (not shown in the figure) and a second end (not shown in the figure) for coupling the memory module connector 100 to the platform PCB 202. The first end of the connector pins 102 is coupled to the memory module connector 100 while the second end is electrically coupled to the platform PCB 202. In one example, the second end of the connector pins 102 may be soldered on the platform PCB 202 to electrically connect the memory module connector 100 and the platform PCB 202.

Further, as previously described, the memory module connector 100 may be connected to the platform PCB 202 for coupling a memory module 204 to the platform PCB 202. The memory module 204 is provided to store data generated, used, or imported in the computing device 200. For instance the memory module 204 may be a cache memory or main memory of the computing device 200. Further, as previously described, the memory module 204 may be, for example, a single in-line memory module (SIMM) or a DIMM. In one example, the memory module 204 includes a PCB (not shown in the figure) having a plurality of memory chips, also known as modules. The memory chips are integrated circuits having storage capabilities. Examples of the memory chips include, but are not limited to, dynamic random access memory (DRAM) and synchronous dynamic random access memory (SDRAM). Further, the memory chips may be Double Data Rate (DDR) memory modules. For instance, the memory module 204 may be DDR DIMMs, such as DDR3 DIMMs, DDR4 DIMMs, and DDR5 DIMMs. For the sake of brevity, and not as a limitation, the figures are described in the context of DDR4 DIMMs.

The memory module 204 further includes a plurality of contact pins 206-1, 206-2, 206-3, . . . , 206-n for creating electrical contacts with the connector pins 102. The contact pins 206-1, 206-2, 206-3, . . . , 206-n are hereinafter collectively referred to as contact pins 206 and individually referred to as contact pin 206. In order to couple the memory module 204 to the memory module connector 100, the memory module 204 is plugged into a plugging slot (not shown in the figure) of the memory module connector 100. The plugging slot is a slot provided in the memory module connector 100 such that the first end of the connector pins 102 lies in the plugging slot. Thus, when the memory module 204 is inserted inside the plugging slot, the contact pins 206 come in contact with the connector pins 102. Bringing the contact pins 206 and the connector pins 102 in contact allows transfer of data and other signals between the platform PCB 202 and the memory module 204.

In one example, the number of contact pins 206 and the connector pins 102 is predetermined based on the type of the memory module 204. For instance, in case of the DDR4 DIMM, the number of connector pins 102 and the contact pins 206 may be equal to 288. Further, the contact pins 206 and the connector pins 102 are distributed into a plurality of columns on the memory module 204 and the memory module connector 100, respectively. For instance, the contact pins 206 are arranged into two columns such that a first column is in a front side of the memory module 204 and a second column is in a back side of the memory module 204. The contact pins 206 are distributed such that one half of the contact pins 206, when arranged in a serial order based on the pin layout of the memory module 204 is positioned in the first column, while the other half is positioned in the second column. For instance, in case of the DDR4 DIMM, 144 contact pins 206 are arranged the first column, while the remaining 144 contact pins 206 are provided in the second column. It should be noted that the number of the contact pins 206 is also determined based on various industry based standards. Any other types of proprietary memory module 204 would also be within the scope of the present subject matter.

Further, the connector pins 102 are distributed in the memory module connector 100 such that the first end of the connector pins 102, present in the plugging slot is divided into two different columns with one column on each side of plugging slot. For instance, in case of the DDR4 DIMM, 144 connector pins 102 are provided in one column, while the remaining 144 connector pins 102 are provided in the other column. Further, on a side of the memory module connector 100 facing the platform PCB 202, the connector pins 102 are distributed into the columns 104. For instance, in case of the DDR4 DIMM, the 288 connector pins are distributed into four columns, say, a first column 104-1, a second column 104-2, a third column 104-3, and a fourth column 104-n such that each column includes 72 connector pins. Further, the connector pins 102 are arranged in the columns 104 such that no two signal pins 108 positioned in different columns 104 are adjacent to each other.

In an example, the connector pins 102 may be distributed in the columns 104 such that two signal pins provided in alternate columns 104 are separated by a ground pin 106 provided in the column 104 in between the alternate columns 104. For instance, the signal pins 108 provided in the first column 104-1 and third column 104-3 are separated by the ground pins 106 provided in the second column 104-2. The ground pins 106 are positioned such that the ground pins 106 in the second column 104-2 are adjacent to the signal pins 108 in the first column 104-1 and third column 104-3. In order to achieve the said positioning of the ground pins 106 and the signal pins 108, the columns 104 are positioned such that the columns 104 having the even numbered connector pins 102 are provided in between the columns 104 having the odd numbered connector pins 102. For instance, the odd numbered connector pins 102 may be positioned in the first column 104-1 and the fourth column 104-n, while the even numbered connector pins 102 may be positioned in the second column 104-2 and the third column 104-3. The odd numbered connector pins 102 correspond to odd numbered contact pins 206 of the memory module 204. The even numbered connector pins 102 correspond to the even numbered contact pins 206.

For instance, in case of the DDR4 DIMM, the odd numbered connector pins 102 may correspond to the contact pins 206 numbered 1, 3, 5, . . . , and 287 in the DIMM, while the even numbered connector pins 102 may correspond to the contact pins 206 numbered 2, 4, 6, . . . , and 288 in the DIMM. Thus, in the case of DDR4 DIMM, the connector pins 102 are positioned such that the connector pins 102 numbered 1, 3, 5, . . . , 143 are arranged in the first column 104-1. The connector pins 102 numbered 2, 4, 6, . . . , 144 are arranged in the second column 104-2, the connector pins 102 numbered 146, 148, 150, . . . , 288 are arranged in the third column 104-3. Such a positioning of the columns 104 positions the connector pins 102 such that for each signal pin 108 provided in a column 104, say, the column 104-1, each connector pin 102 adjacent to the signal pin 104 in an adjacent column 104, say, the column 104-2 is a ground pin 106.

In another example, the columns 104 may be positioned such that the columns 104 having the odd numbered connector pins 102 are provided in between the columns 104 having the even numbered connector pins 102. For instance, the odd numbered connector pins 102 may be positioned in the second column 104-2 and the third column 104-3, while the even numbered connector pins 102 may be positioned in the first column 104-1 and the fourth column 104-n. Thus, in the case of DDR4 DIMM, the connector pins 102 are positioned such that the connector pins 102 numbered 2, 4, 6, . . . , 144 are arranged in the first column 104-1. The connector pins 102 numbered 1, 3, 5, . . . , 143are arranged in the second column 104-2, the connector pins 102 numbered 145, 147, 149, . . . , 287 are arranged in the third column 104-3. The connector pins 102 numbered 146, 148, 150, . . . , 288 are arranged in the fourth column 104-n.

In another example, the connector pins 102 are distributed in the columns 104 such that signal pins 108 and the ground pins 106 are not positioned in the same column 104. The signal pins 108 and the ground pins 106 are distributed such that two columns 104 comprising the signal pins 108 are separated by two other columns 104 comprising the ground pins 106. For instance, in case of DDR4 DIMM, the connector pins 102 are positioned such that the signal pins 108 are distributed into the first column 104-1 and the fourth column 104-n. The ground pins 106 are distributed into the second column 104-2 and the third column 104-3. Such a positioning of the connector pins 102 facilitates in ensuring that the signal pins 108 provided in two different columns 104 are never adjacent to each other. The signal pins 108 are separated by two ground pins 106, thus achieving a reduction in crosstalk between the signal pins 108. Further, such a positioning of the connector pins 102 facilitates in achieving the shielding of the signal pins 108 without requiring any change in the pin layout of the memory module 204.

Further, in said example the connector pins 102 are positioned in the columns such that the adjacent data strobe pins (not shown in the figure) in the same column 104 are positioned relatively closer to each other as compared to the other connector pins 102. The data strobe pins are provided to carry data strobe signals that are used to indicate when read and write data are to be registered. The two adjacent data strobe pins are positioned such that they are separated by a distance equal to a coupling distance. The coupling distance is a distance less than a distance by which other connector pins 102 provided in the same column 104 are separated. In one example, the coupling distance is equal to about 0.12 millimeters (mm).

Figure 3:
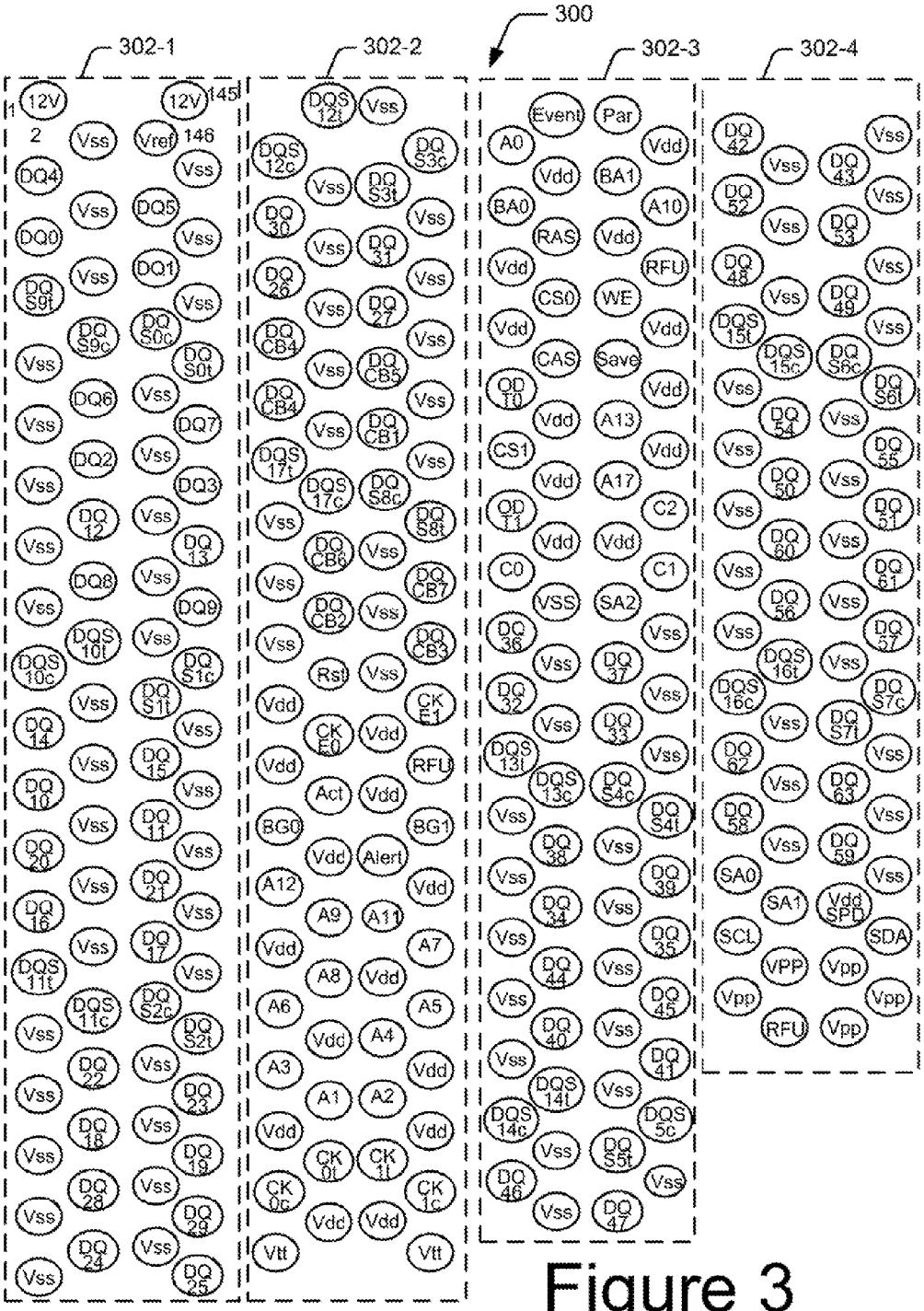
FIG. 3 illustrates a connector pin layout of the memory module connector, according to an example of the present subject matter.

FIG. 3 illustrates a connector pin layout 300 of the memory module connector 100, according to an example of the present subject matter. The pin layout 300 illustrates positioning of the connector pins 102 on the side of the memory module connector 100 facing the platform PCB 202. For the sake of explanation, and not as a limitation, the pin layout of a DDR4 DIMM has been used as the pin layout 300. The pin layout 300 positions the connector pins 102 into the four columns 104 such that a first half of the connector pins 102, say, connector pins 102 numbered 1 to 144 for the DDR4 DIMM are distributed into first two columns 104-1 and 104-2. A second half of the connector pins 102, say, connector pins 102 numbered 145 to 288 for a DDR4 DIMM are distributed into last two columns 104-3 and 104-n. For illustration purposes, and not as a limitation, the pin layout 300 has been divided into four segments so as to display the complete pin layout 300 in a single page.

In one example, the pin layout 300 has been divided into a first segment 302-1, a second segment 302-2, a third segment 302-3, and a fourth segment 302-4. The first segment 302-1, a second segment 302-2, a third segment 302-3, and a fourth segment 302-4 are collectively referred to as segments 302 and individually as segment 302. The first segment 302-1 illustrates the connector pins 102 numbered 1 to 39 in the columns 104-1 and 104-2 and the connector pins 102 numbered 145 to 183 in the columns 104-3 and 104-n. The second segment 302-2 illustrates the connector pins 102 numbered 40 to 77 in the columns 104-1 and 104-2 and the connector pins 102 numbered 184 to 221 in the columns 104-3 and 104-n. The third segment 302-3 illustrates the connector pins 102 numbered 78 to 115 in the columns 104-1 and 104-2 and the connector pins 102 numbered 222 to 258 in the columns 104-3 and 104-n. The fourth segment 302-4 illustrates the connector pins 102 numbered 115 to 144 in the columns 104-1 and 104-2 and the connector pins 102 numbered 259 to 288 in the columns 104-3 and 104-n. Thus, in order to obtain the complete pin layout 300 of the DDR4 DIMM, the segments 302 can be arranged in the order of 302-1, 302-2, 302-3, and 302-4.

As illustrated in the FIG. 3, the columns 104 are arranged such that the columns 104 having the even numbered connector pins 102, i.e., the columns 104-2 and 104-3 are provided in between the columns 104 having the odd numbered connector pins 102, i.e., the columns 104-1 and 104-n. Such an arrangement of the columns 104 facilitates in achieving a positioning of the connector pins 102 such that the signal pins 108 provided in alternate columns 104 are separated by the ground pins 106 provided in the column 104 in between the alternate columns 104. For instance, for the signal pins 108 (DQ) provided in the column 104-2, a ground pin 106 (Vss) is provided adjacent to the signal pin 108 in the adjacent columns 104-1 and 104-3.

Figure 4:
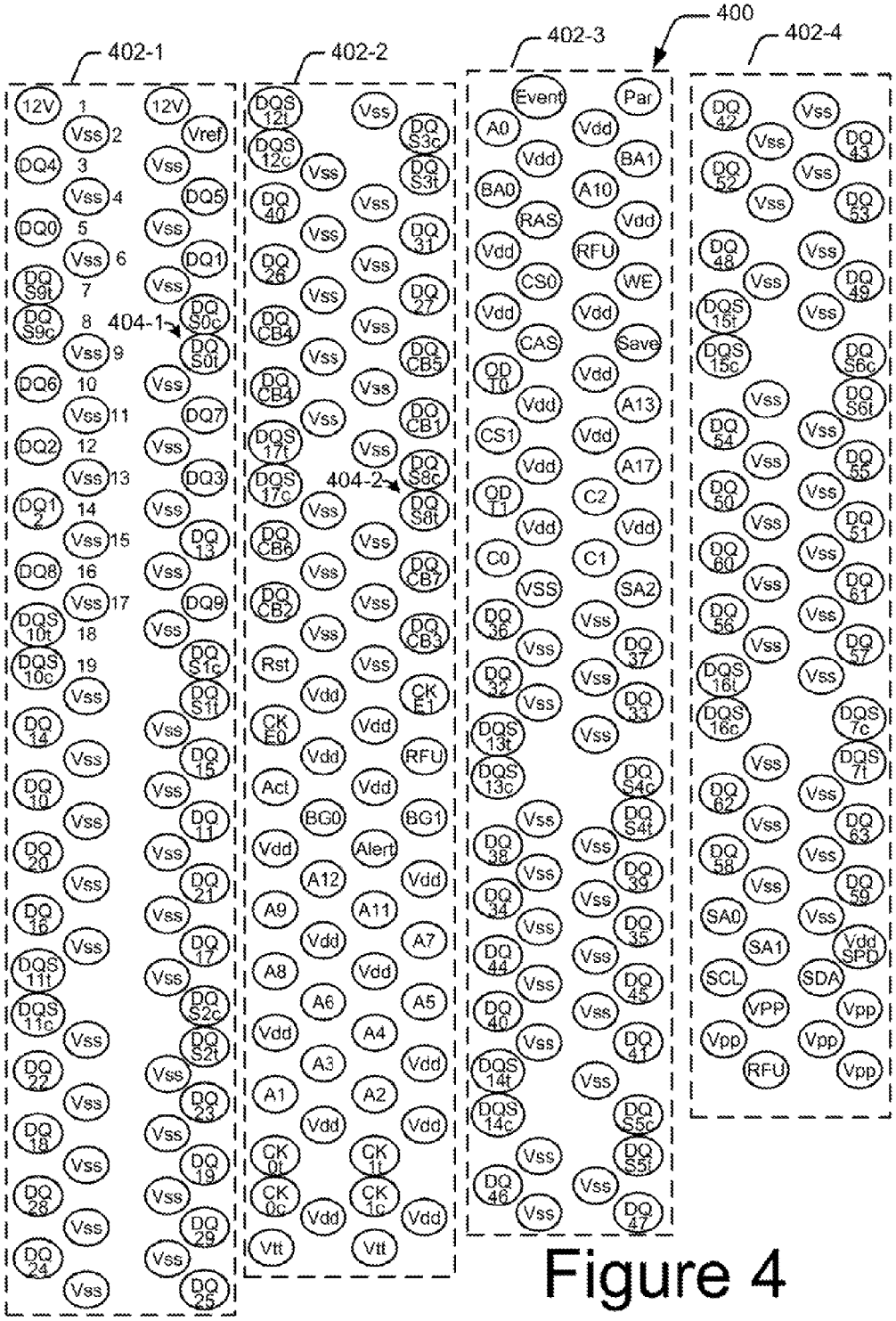
FIG. 4 illustrates a connector pin layout of the memory module connector, in accordance with an example of the present subject matter.

FIG. 4 illustrates a connector pin layout 400 of the memory module connector 100, according to an example of the present subject matter. The pin layout 400 corresponds to the pin layout 300 albeit with few modifications as per the present example. For illustration purposes, and not as a limitation, the pin layout 400 has been divided into four segments so as to display the complete pin layout 400 in a single page.

In one example, the pin layout 400 has been divided into a first segment 402-1, a second segment 402-2, a third segment 402-3, and a fourth segment 402-4. The first segment 402-1 corresponds to the first segments 302-1 and illustrates the connector pins 102 numbered 1 to 39 and 145 to 183. The second segment 402-2 corresponds to the second segment 302-2 and illustrates the connector pins 102 numbered 40 to 77 and 184 to 221. The third segment 402-3 corresponds to the third segment 302-3 and illustrates the connector pins 102 numbered 78 to 115 and 222 to 258. The fourth segment 402-4 corresponds to the fourth segment 302-4 and illustrates the connector pins 102 numbered 115 to 144 259 to 288. Thus, in order to obtain the complete pin layout 400 of the DDR4 DIMM, the segments 402 can be arranged in the order of 402-1, 402-2, 402-3, and 402-4.

As illustrated in the FIG. 4, the connector pins 102 are distributed into the columns 104 such that the signal pins 108 (DQ) are provided in the columns 104-1 and 104-n, while the ground pins 106 (Vss) are provided in the columns 104-2 and 104-3, separating the columns 104-1 and 104-n. Providing the ground pins 106 and the signal pins 108 in separate columns 104 such that the signal pins 108 provided in separate columns 104 are separated by two ground pins 106. For instance, for the signal pins 108 provided in the columns 104-1 and 104-n are separated by the ground pins 106 provided in the columns 104-2 and 104-3.

Further, as illustrated in the FIG. 4, adjacent data strobe pins (DQS) in the same column 104 are positioned relatively closer to each other as compared to the other connector pins 102. For instance, the data strobe pins DQS0c and DQS0t as indicated by an arrow 404-1 and the data strobe pins DQS8c and DQS8t as indicated by an arrow 404-2 are separated by a distance equal to the coupling distance. In one example, the coupling distance is equal to about 0.12 mm.

Although examples for the present subject matter have been described in language specific to structural features and/or methods, the present subject matter is not necessarily limited to the specific features or methods described. Rather, the specific features and methods are disclosed and explained in the context of a few examples of the present subject matter.

We claim:

1. A memory module connector comprising a plurality of connector pins distributed into a plurality of columns, wherein the plurality of connector pins comprises:

a plurality of ground pins for providing electrical ground to the memory module connector; and a plurality of signal pins for carrying data signals across the memory module connector, wherein, for each signal pin provided in a column, each connector pin adjacent to the signal pin in an adjacent column is a ground pin, wherein the plurality of connector pins further comprises a set of data strobe pins, and wherein two adjacent data strobe pins, arranged in a same column of connector pins, are separated by a coupling distance, and wherein the coupling distance is less than a distance by which other connector pins arranged in the same column are separated.

2. The memory module connector as claimed in claim 1, wherein the plurality of connector pins are distributed into a first column, a second column, a third column, and a fourth column, and wherein the signal pins are distributed into the first column and the fourth column, and wherein the ground pins are distributed into the second column and the third column separating the first column and the fourth column.

3. The memory module connector as claimed in claim 1, wherein the memory module connector comprises 288 connector pins.

4. The memory module connector as claimed in claim 1, wherein the plurality of connector pins are arranged into n number of columns, and wherein each column comprises 1/n number of the plurality of connector pins.

5. The memory module connector as claimed in claim 1, wherein the signal pins provided in alternate columns are separated by the ground pins provided in a column separating the alternate columns.

6. The memory module connector as claimed in claim 5, wherein the connector pins comprises a set of odd numbered connector pins and a set of even numbered connector pins, and wherein the odd numbered connector pins are distributed into a first column and a fourth column, and wherein the even numbered connector pins are distributed into a second column and a third column.

7. The memory module connector as claimed in claim 5, wherein the connector pins comprises a set of odd numbered connector pins and a set of even numbered connector pins, and wherein the even numbered connector pins are distributed into a first column and a fourth column, and wherein the odd numbered connector pins are distributed into a second column and a third column.

8. A computing device comprising:

a platform printed circuit board (PCB) ; and a memory module connector electrically coupled to the platform PCB for coupling a memory module to the platform PCB , wherein the memory module connector comprises a plurality of connector pins distributed into a plurality of columns , and wherein the plurality of connector pins comprises:

a plurality of ground pins for providing electrical ground to the memory module connector; and a plurality of signal pins for carrying data signals across the memory module connector, wherein no two signal pins provided in separate columns from among the plurality of columns are adjacent to each other, and wherein the signal pins provided in the separate columns are separated by at least one ground pin, from among the set of ground pins; and a set of data strobe pins.

9. The computing device as claimed in claim 8, wherein the plurality of ground pins are distributed into two columns from among the plurality of columns, and wherein the plurality of signal pins are distributed into at least two columns from among the plurality of columns, and wherein the at least two columns comprising the signal pins are separated by the two columns comprising the ground pins.

10. The computing device as claimed in claim 8, wherein the memory module connector comprises 288 connector pins, and wherein the 288 connector pins are arranged into four columns, and wherein each column comprises 72 connector pins.

11. The computing device as claimed in claim 8, wherein the plurality of connector pins are distributed into four columns, and wherein odd numbered connector pins, from among the plurality of connector pins, are distributed into a first column and a fourth column, and wherein even numbered connector pins, from among the plurality of connector pins, are distributed into a second column and a third column.

12. The computing device as claimed in claim 8, wherein the connector pins comprise a set of odd numbered connector pins through that and a set of even numbered connector pins, and wherein the even numbered connector pins are distributed into a first column and a fourth column, and wherein the odd numbered connector pins are distributed into a second column and a third column.

13. The computing device as claimed in claim 8 further comprising a plugging slot for receiving a memory module.

14. The computing device as claimed in claim 8, wherein the set of data strobe pins comprises two adjacent data strobe pins arranged in a same column of connector pins are separated by a coupling distance, wherein the coupling distance is less than a distance by which other connector pins arranged in the same column are separated.

15. The computing device as claimed in claim 8, wherein the plurality of signal pins comprises a first subset of consecutive signal pins arranged in a first column and a second subset of consecutive signal pins arranged in the first column, wherein the plurality of ground pins comprise a first subset of consecutive ground pins arranged in the first column and a second subset of consecutive ground pins arranged in the first column, wherein the first subset of consecutive signal pins is sandwiched between the first subset of consecutive ground pins and the second subset of consecutive ground pins and wherein the first subset of consecutive ground pins is sandwiched between the first subset of consecutive signal pins and the second subset of consecutive signal pins.

16. The computing device as claimed in claim 15, wherein the plurality of signal pins comprises a third subset of consecutive signal pins arranged in a second column adjacent the first column and a fourth subset of consecutive signal pins arranged in the second column, wherein the plurality of ground pins comprise a third subset of consecutive ground pins arranged in the second column and a fourth subset of consecutive ground pins arranged in the second column, wherein the third subset of consecutive signal pins is sandwiched between the third subset of consecutive ground pins and the fourth subset of consecutive ground pins, wherein the third subset of consecutive ground pins is sandwiched between the third subset of consecutive signal pins and the fourth subset of consecutive signal pins, wherein the first subset of consecutive signal pins extends adjacent the third subset of consecutive ground pins and wherein the second subset of consecutive ground pins extends adjacent the fourth subset of consecutive signal pins.

17. The computing device as claimed in claim 16, wherein the set of data strobe pins comprises:

a first data strobe pin in the first column between the first subset of consecutive ground pins and the first subset of consecutive signal pins; and a second data strobe pin in the second column between the third subset of consecutive data signal pins and the third subset of consecutive ground pins, wherein the second data strobe pin is adjacent the first data strobe pin.

18. The computing device as claimed in claim 16, wherein the plurality of signal pins comprises a fifth subset of consecutive signal pins arranged in a third column adjacent the second column and a sixth subset of consecutive signal pins arranged in the third column, wherein the plurality of ground pins comprise a fifth subset of consecutive ground pins arranged in the third column and a sixth subset of consecutive ground pins arranged in the third column, wherein the fifth subset of consecutive signal pins is sandwiched between the fifth subset of consecutive ground pins and the sixth subset of consecutive ground pins, wherein the fifth subset of consecutive ground pins is sandwiched between the fifth subset of consecutive signal pins and the sixth subset of consecutive signal pins and wherein the fifth subset of consecutive signal pins extends adjacent the third subset of consecutive ground pins and wherein the sixth subset of consecutive ground pins extends adjacent the fourth subset of consecutive signal pins.

19. A memory module connector comprising a plurality of connector pins distributed into a plurality of columns, wherein the plurality of connector pins comprises:

a plurality of ground pins for providing electrical ground to the memory module connector, wherein the plurality of ground pins comprise a first subset of consecutive ground pins arranged in the first column and a second subset of consecutive ground pins arranged in the first column;

a plurality of signal pins for carrying data signals across the memory module connector, wherein the plurality of signal pins comprises a first subset of consecutive signal pins arranged in a first column and a second subset of consecutive signal pins arranged in the first column, wherein the first subset of consecutive signal pins extends adjacent the third subset of consecutive ground pins and wherein the second subset of consecutive ground pins extends adjacent the fourth subset of consecutive signal pins; and a set of data strobe pins in the first column.

20. The memory module connector as claimed in claim 19, wherein the plurality of signal pins comprises a third subset of consecutive signal pins arranged in a second column adjacent the first column and a fourth subset of consecutive signal pins arranged in the second column, wherein the plurality of ground pins comprise a third subset of consecutive ground pins arranged in the second column and a fourth subset of consecutive ground pins arranged in the second column, wherein the third subset of consecutive signal pins is sandwiched between the third subset of consecutive ground pins and the fourth subset of consecutive ground pins, wherein the third subset of consecutive ground pins is sandwiched between the third subset of consecutive signal pins and the fourth subset of consecutive signal pins, wherein the first subset of consecutive signal pins extends adjacent the third subset of consecutive ground pins and wherein the second subset of consecutive ground pins extends adjacent the fourth subset of consecutive signal pins.

* * * * *